US009837038B2

(12) United States Patent
Lee

(10) Patent No.: US 9,837,038 B2
(45) Date of Patent: Dec. 5, 2017

(54) DISPLAY PANEL

(71) Applicant: Au Optronics Corporation, Hsinchu (TW)

(72) Inventor: Chia-Hwa Lee, Taipei (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 14/848,345

(22) Filed: Sep. 9, 2015

(65) Prior Publication Data

US 2016/0232837 A1 Aug. 11, 2016

(30) Foreign Application Priority Data

Feb. 5, 2015 (TW) ..... 104103876 A

(51) Int. Cl.

*G09G 3/20* (2006.01)
*G09G 3/36* (2006.01)
*G09G 3/3275* (2016.01)

(52) U.S. Cl.

CPC ..... *G09G 3/3688* (2013.01); *G09G 3/3275* (2013.01); *G09G 2300/0426* (2013.01); *G09G 2310/0297* (2013.01)

(58) Field of Classification Search

CPC ..... G09G 3/3688; G09G 3/3275; G09G 2300/0426; G09G 2310/0297; G09G 3/2092; G09G 2310/0275; G09G 3/20; G09G 2330/028

See application file for complete search history.

(56) References Cited

U.S. PATENT DOCUMENTS

| | | | | |
|---|---|---|---|---|
| 7,423,343 | B2 | 9/2008 | Kurokawa | |
| 7,655,560 | B2 | 2/2010 | Kurokawa | |
| 9,099,054 | B2 | 8/2015 | Kim | |
| 2005/0040531 | A1 | 2/2005 | Kurokawa | |
| 2005/0117611 | A1* | 6/2005 | Shin | G09G 3/325 370/536 |
| 2009/0004846 | A1 | 1/2009 | Kurokawa | |
| 2010/0141570 | A1* | 6/2010 | Horiuchi | G09G 3/3611 345/100 |
| 2013/0141320 | A1 | 6/2013 | Kim | |
| 2015/0199936 | A1* | 7/2015 | Watanabe | G09G 3/3685 345/100 |

(Continued)

FOREIGN PATENT DOCUMENTS

| | | |
|---|---|---|
| CN | 1581472 | 2/2005 |
| CN | 1697006 | 11/2005 |
| CN | 1741110 | 3/2006 |

(Continued)

*Primary Examiner* — Lun-Yi Lao
*Assistant Examiner* — Jarurat Suteerawongsa
(74) *Attorney, Agent, or Firm* — JCIPRNET

(57) ABSTRACT

A display panel uses demultiplexers to reduce numbers of data lines, and divides the data lines into groups being coupled to the demultiplexers respectively. The demultiplexers are disposed along an edge of the display region and compliant to the outline of the display panel, so as to save the layout space. In addition, the layout of control lines of the demultiplexers can be configured to more effectively utilize the layout space in the layout region. Furthermore, the aforementioned layout helps reduce the length of the conductive lines, and improves the transmission of signals in the conductive lines.

9 Claims, 5 Drawing Sheets

(56) References Cited

U.S. PATENT DOCUMENTS

2016/0055789 A1* 2/2016 Hashimoto ..... G09G 3/2092
345/204

FOREIGN PATENT DOCUMENTS

| | | |
|---|---|---|
| CN | 101295081 | 10/2008 |
| CN | 103137089 | 6/2013 |
| CN | 104332132 | 2/2015 |
| JP | 2005182339 | 7/2005 |
| TW | 201025272 | 7/2010 |

* cited by examiner

DISPLAY PANEL

CROSS-REFERENCE TO RELATED APPLICATION

This application claims the priority benefit of Taiwan application serial no. 104103876, filed on Feb. 5, 2015. The entirety of the above-mentioned patent application is hereby incorporated by reference herein and made a part of this specification.

BACKGROUND OF THE INVENTION

1. Field of the Invention

The invention relates to a display panel.

2. Description of Related Art

Recently, the maturing of semiconductor manufacturing and optoelectronic technologies have brought forward the development of display panel technologies. Common display panels include liquid crystal display panels and organic electroluminescent display panel, etc. Generally speaking, a display panel includes a display region, an external circuit region located outside the display region, and a layout region located between the display region and the external circuit region. A plurality of pixel regions are arranged in an array in the display region, while the external circuit region includes a contact point and potentially include a driving circuit. There are a plurality of conductive lines in non-display regions to electrically connect the pixel structures to the driving circuit or electrically connect the pixel structures to the external circuit through the contact point, so as to receive a control signal and display information required for displaying.

The display apparatuses nowadays are developed toward lightness, slimness, slim bezel, and high image quality. Through broadening of the applicable fields, the display region of the display panel is no longer limited to be rectangular, as in the conventional display apparatuses. For example, the emergence of wearable electronic devices, such as smart watches, leads to the needs for display panels having a display region in a circular shape or other shapes.

Also, to cope with the contact point of the driving chip, conductive lines (e.g., data lines) conventionally disposed in the non-display regions are arranged in a fan-out structure, and zigzag and extend along horizontal and vertical directions. FIG. 1 is a view illustrating a conventional display panel 100 having a circular display region 110, a layout region 120 located outside the display region 110, and an external circuit region 130 at the outermost. In addition, referring to a layout of conductive lines in the layout region 120 of the display panel 100 shown in FIG. 2, a plurality of pixel structures 112 are in the display region 110, a plurality of conductive lines 122 extend from the external circuit region 130 (as shown in FIG. 1) at the periphery of the non-display regions, pass through the layout region 120, and connect the corresponding pixel structures 112. A circle 190 in a dotted line shown in FIG. 2 is a minimum circular region required to dispose the conductive lines 122.

As shown in FIG. 2, the conductive lines 122 take up a certain area of the layout region 120. If the layout of the conductive lines 122 is not appropriately designed, the conductive lines may take up a significant area of the layout region 120, and thus hinder the slim bezel development of the display panel, or relatively limit a usable area of the display region 110. Besides, if the conductive lines 122 are too long, a resistance value of the conductive lines 122 may be too high, and an accuracy of signal transmission may be influenced. For example, a difference in delay of signal transmission between different conductive lines may be rendered.

SUMMARY OF THE INVENTION

The invention provides a display panel where conductive lines outside a display region are appropriately disposed to cope with needs for different shapes of the display region, so as to effectively use a layout space of the display panel and help development of a slim bezel design of the display panel or increase a visible region of the display panel.

The invention provides a display panel where a layout of the conductive lines outside is significantly simplified, a length of the conductive lines is reduced, and an accuracy of signal transmission between the conductive lines is ensured.

A display panel of the invention has a display region, a layout region, and an external circuit region. The external circuit region is located at an edge of the display panel, and the layout region is located between the display region and the external circuit region. The display panel includes a plurality of pixel structures, a plurality of demultiplexers, a plurality of first data lines, a plurality of second data lines, a plurality of control lines, a plurality of gate drivers, a plurality of first scan lines, and a plurality of second lines. The pixel structures are disposed in the display region. The demultiplexers are disposed in the layout region. In addition, the demultiplexers are arranged along an edge of the display region, and at least two of the demultiplexers are not located on the same horizontal axis. The first data lines extend from the external circuit region to the layout region and are respectively coupled to the demultiplexers. The second scan lines are vertical to the horizontal axis and divided into a plurality of groups. In addition, at least two second scan lines in each of the groups are coupled between the corresponding demultiplexers and the corresponding pixel structures. Each of the demultiplexers receives a first data signal from the corresponding first data line, multiplexes the first data signal into at least two second data signals, and respectively transmits the second data signals to the at least two second data lines. The control lines extend from the external circuit region to the layout region and are respectively coupled to the demultiplexers. The gate drivers are disposed in the layout region. The first data lines extend from the external circuit region to the layout region, and are respectively coupled to the gate drivers. The second scan lines are divided into a plurality of groups. At least two second scan lines in each of the groups are coupled between the corresponding gate driver and the corresponding pixel structures.

According to an embodiment of the invention, the control lines includes a plurality of connecting line segments and a plurality of bus line segments. The connecting line segments are located in the layout region, and are divided into a plurality of groups. At least two connecting line segments are coupled to the corresponding demultiplexer. The bus line segments extend from the external circuit region to the layout region and are coupled to the corresponding connecting line segments.

According to an embodiment of the invention, the display panel includes a first circuit layer, a second circuit layer, and an insulating layer. The first circuit layer includes the first data lines, the second data lines, the first scan lines, and the bus line segments. The second circuit layer is alternately stacked with the first circuit layer. In addition, the second circuit layer includes the second scan lines and the connecting line segments. The insulating layer is located between the first circuit layer and the second circuit layer, such that the first circuit layer is insulated from the second circuit layer.

According to an embodiment of the invention, at least two of the bus line segments are arranged to be side by side and parallel to the first scan lines.

According to an embodiment of the invention, the edge of the display region is curved, and each of the bus line segments is a curved line parallel to the edge of the display region.

According to an embodiment of the invention, the display region is circular, and each of the bus line segments is an arc line parallel to the edge of the display region.

According to an embodiment of the invention, each of the control lines includes a plurality of first line segments and a plurality of second line segments. In addition, the first line segments are located in the layout region, and are coupled to and cross the corresponding demultiplexers respectively. The second line segments are located in the layout region. Moreover, the first line segments and the second line segments are arranged alternately, and the first and second line segments are coupled to each other through their head and tail portions.

According to an embodiment of the invention, the display panel includes a first circuit layer, a second circuit layer, and an insulating layer. The first circuit layer includes the first data lines, the second data lines, the first scan lines, and the second line segments. The second circuit layer is alternately stacked with the first circuit layer. In addition, the second circuit layer includes the second scan lines and the first line segments. The insulating layer is located between the first circuit layer and the second circuit layer, such that the first circuit layer is insulated from the second circuit layer.

According to an embodiment of the invention, the edge of the display region is curved, and each of the first scan lines is a curved line parallel to the edge of the display region.

According to an embodiment of the invention, the display region is circular, and each of the first scan lines is an arc line parallel to the edge of the display region.

According to an embodiment, each of the pixel structures is coupled to at least two second data lines.

Based on the above, in the display panel of the invention, the demultiplexers are used to reduce the number of the data lines in the layout region to save a layout space. Also, the data lines are divided into groups in the invention, such that the data lines are coupled to different demultiplexers. The demultiplexers are arranged along the edge of the display region to comply with the outline of the display region. In particular, when the arrangement is applied in a display panel having a non-rectangular display region, a waste of layout space in a conventional layout of conductive lines may be prevented. In this way, the layout space on the display panel is effectively used to help development of a slim bezel of the display apparatus or increase a visible region of the display panel. Also, the layout of the conductive lines may be significantly simplified, and the length of the conductive lines may be reduced, so as to ensure the accuracy of signal transmission between the conductive lines.

To make the above features and advantages of the invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
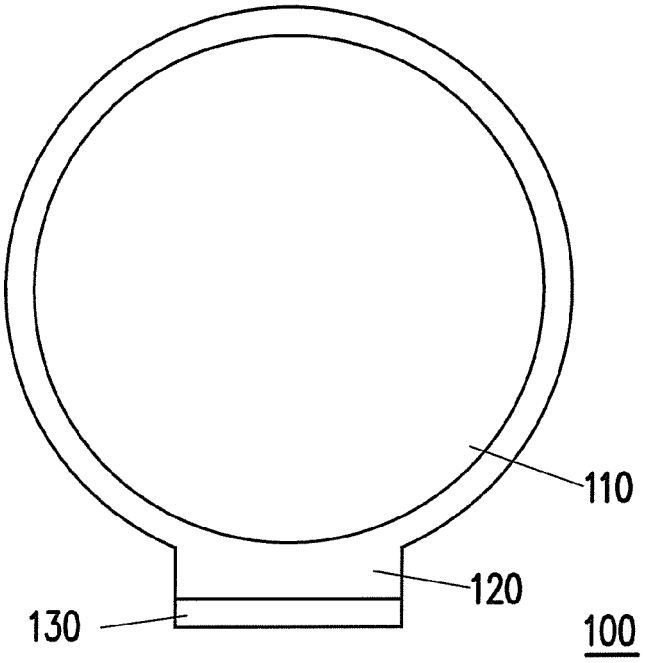
FIG. 1 (RELATED ART)
FIG. 1 is a view illustrating a conventional display panel.
Figure 2:
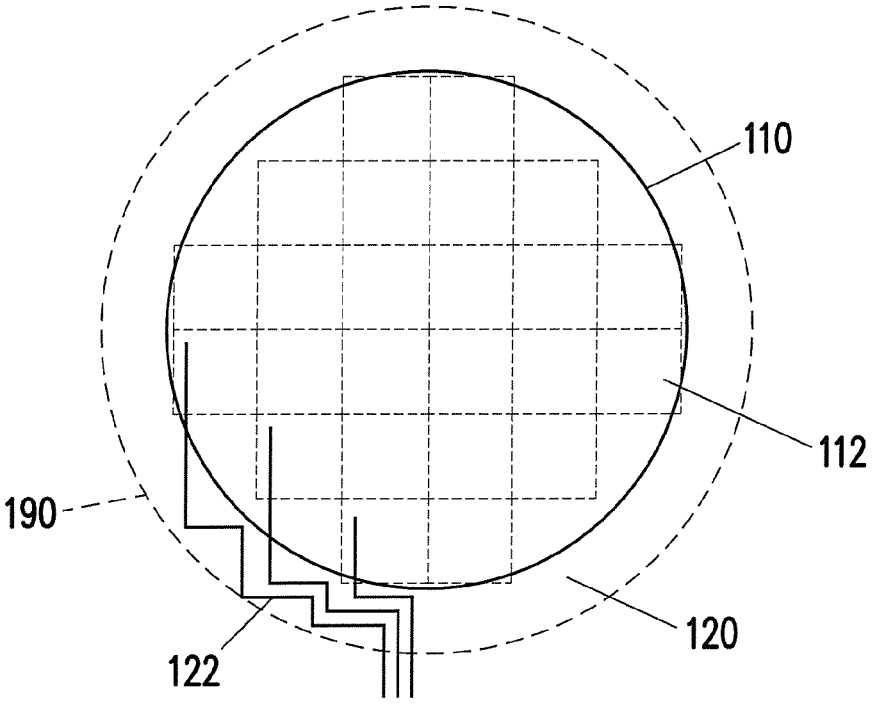
FIG. 2 (RELATED ART)
FIG. 2 is a view illustrating a layout of conductive lines in a layout region in the display panel shown in FIG. 2.

Reference will now be made in detail to the present preferred embodiments of the invention, examples of which are illustrated in the accompanying drawings. Wherever possible, the same reference numbers are used in the drawings and the description to refer to the same or like parts.

Figure 3:
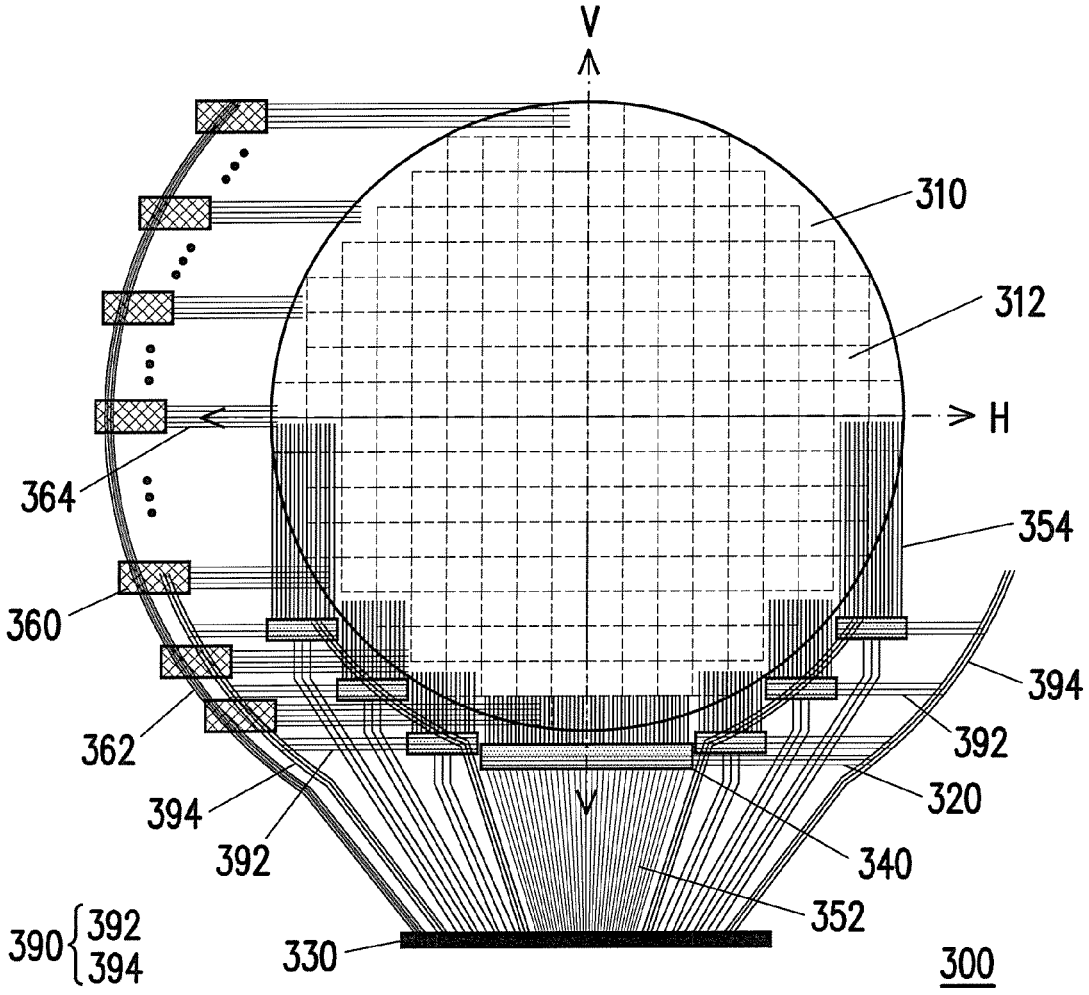
FIG. 3 is a view illustrating a display panel according to an embodiment of the invention.

FIG. 3 is a view illustrating a display panel 300 according to an embodiment of the invention. The display panel 300 has a display region 310, a layout region 320, and an external circuit region 330. The display region 310 includes a plurality of pixel structures 312. The display panel 300 of this embodiment is a liquid crystal display panel, an organic electroluminescent display panel, etc., for example. The pixel structure 312 may include an active device, a pixel electrode, a liquid crystal light valve, and a color filter of the liquid crystal display panel, for example. Alternatively, the pixel structure 312 may include a cathode, an organic luminescent layer, and an anode, etc., of the organic electroluminescent display panel.

In this embodiment, a shape of the display region 310 is circular, for example. However, in other embodiment of the invention that are not shown herein, the shape of the display region 310 may also be other non-rectangular shapes, such as shapes of an ellipse, a heart, a water drop, or a sector, etc. In addition, the pixel structures 312 are arranged into an array along a horizontal axis H and a vertical axis V, for example. However, the invention does not intend to limit the arrangement of the pixel structures 312. The arrangement of the pixel structures 312 may be modified based on practical design needs.

The external circuit region 330 is located at an edge of the display panel 300. In addition, electronic elements such as a driving circuit or a contact point connected to an external circuit may be disposed at the circuit region 330. Detailed description about electronic elements such as the driving circuit and the contact point will be omitted in the following. Based on the conventional technical level and the disclosure of the invention, people having ordinary skills in the art should be able to reasonably infer a specific structure of electronic elements possibly disposed in the external circuit region 330.

The layout region 320 is located between the display region 310 and the external circuit region 330.

Figure 4:
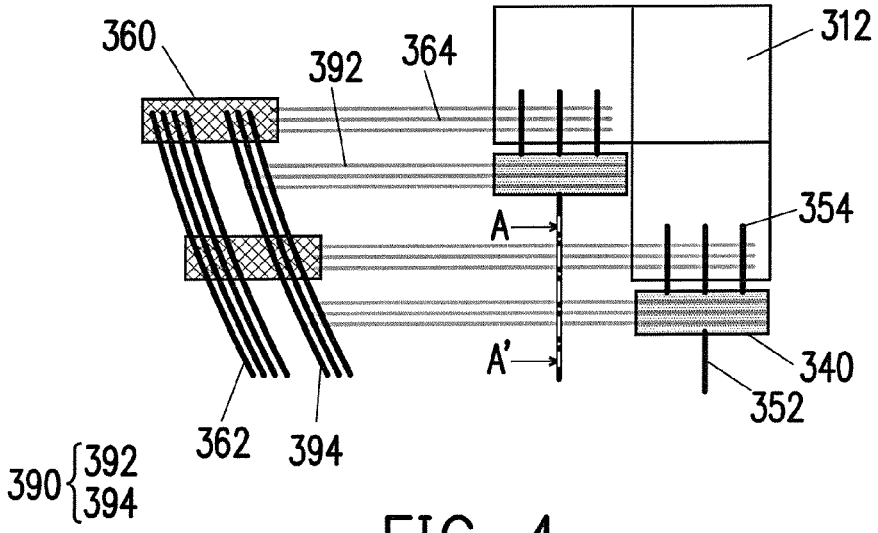
FIG. 4 is a partial schematic view of the display panel shown in FIG. 3.

FIG. 4 is a partial schematic view of the display panel 300 shown in FIG. 3. To make the figures clearer, wirings shown in FIGS. 3 and 4 are only shown for an illustrative purpose. An actual layout shall be based on the understanding of the people having ordinary skills in the art after considering the contents of the disclosure. For example, the actual numbers of first data lines 352, second data lines 354, first scan lines 362, second scan lines 364, connecting line segments 392, bus line segments 394, etc., shall be based on an actual layout. Also, to make the drawings clearer, FIGS. 3 and 4 also omit some other circuits that may be present and may be reasonably inferred based on the disclosure of the invention.

Referring to FIGS. 3 and 4 together, a plurality of demultiplexers 340 are used in the display panel 300 of this embodiment to reduce the number of data lines. The first data lines 352 extend from the external circuit region 330 to the layout region 320, and are respectively coupled the corresponding demultiplexers 340. In addition, the second data lines 354 are vertical to the horizontal axis H and are divided into a plurality of groups. At least two second data lines 354 (shown as three second data lines in FIG. 4) of each group are coupled between the corresponding demultiplexer 340 and the corresponding pixel structures 312. Control lines 390 extend from the external circuit region 330 to the layout region 320, and are respectively coupled to the corresponding demultiplexers 340, so as to control operations of the demultiplexers 340. In other words, each of the demultiplexers 340 receives a first data signal from the corresponding first data line 352, multiplexes the first data signal into at least two second data signals, and respectively transmits the second data signals to the corresponding second data lines 354. In this way, the number of the first data lines 352 is significantly less than the number of the second data lines 354, and a layout space required in the layout region 320 may be reduced.

In addition, since the display region 310 of the display panel 300 is not rectangular, the demultiplexers 340 are arranged along an edge (e.g., edge of a lower half) of the display region 310 in this embodiment, so as to comply with an outline of the display region 310. In other words, the demultiplexers 340 are not located on the same horizontal axis, and may keep different pitches with respect to the horizontal axis H shown in FIG. 3. Moreover, the layout space taken by the second data lines 354 may be further effectively reduced when the demultiplexers 340 are close to the edge of the display region 310 as much as possible.

Correspondingly, a plurality of gate drivers 360 in this embodiment are disposed in the layout region 320, and are arranged along an edge (e.g., edge of a left side), so as to comply with the outline of the display region 310. The first data lines 362 extend from the external circuit region 330 to the layout region 320, and are respectively coupled to the gate drivers 360. The second scan lines 364 are divided into a plurality of groups, and are coupled between the corresponding gate drivers 360 and the pixel structures 312. Here, the first scan line 362 serves as a bus line for driving the gate driver 360, for example, and the second scan line 364 is a scan line manufactured at the same time with the gate driver 360.

Continuing to refer to FIG. 4, in this embodiment, each of the control lines 390 includes the connecting line segment 392 and the bus line segment 394. The connecting line segments 392 are located in the layout region 320, and are divided into a plurality of groups. At least two connecting line segments 392 (shown as three connecting line segments 392 in FIG. 4) are coupled to the corresponding demultiplexer 340. The bus line segments 394 extend from the external circuit area 330 to the layout region 320 and are coupled to the corresponding connecting line segments 392 to transmit control signals (e.g., clock signal) to the corresponding demultiplexers 340. In other words, the connecting line segments 392 are control lines of the demultiplexers 340, and the bus line segments 394 are bus lines of the demultiplexers 340.

Moreover, the bus line segments 394 of this embodiment are arranged side by side with the first scan lines 362, and the bus line segments 394 and the first scan lines 362 are parallel to each other. When the display region 310 is non-rectangular and has a curved edge, the bus line segments 394 and the first scan lines 362 may be optionally formed as curved lines parallel to the edge of the display region 310. The curved edge of the display area 310 described herein indicates that when the display region 310 is spread out as a plane, at least a portion of the edge of the display region 310 is curved. For example, the display region 310 of this embodiment is circular, so the bus line segments 394 and the first scan lines 362 are arc lines parallel to the edge of the display region 310. Namely, in this embodiment, the first scan lines 362 and the bus line segments 394 of the control lines 390 in this embodiment are arranged to be side by side and parallel to each other in the layout region 320 at a periphery of the display region 310, and the first scan lines 362 and the bus line segments 394 of the control lines 390 are designed to extend along an outline of the edge of the display region 310, so as to form a circuit structure similar to a bus. Meanwhile, scan signals and the control signals are transmitted to the corresponding pixel structures 312 and the demultiplexers 340 through the second scan lines 364 and the connecting line segments 392 in the horizontal direction.

In this embodiment, manufacture of the control lines 390 may be integrated in manufacture processes of the first scan lines 362, the second scan lines 364, the first data lines 352, and the second data lines 354. Also, to cope with the needs of crossing of lines, the first scan lines 362, the second scan lines 364, the first data lines 352, the second data lines 354, and the control lines 390 may be manufactured in two or more circuit layers.

Figure 5:
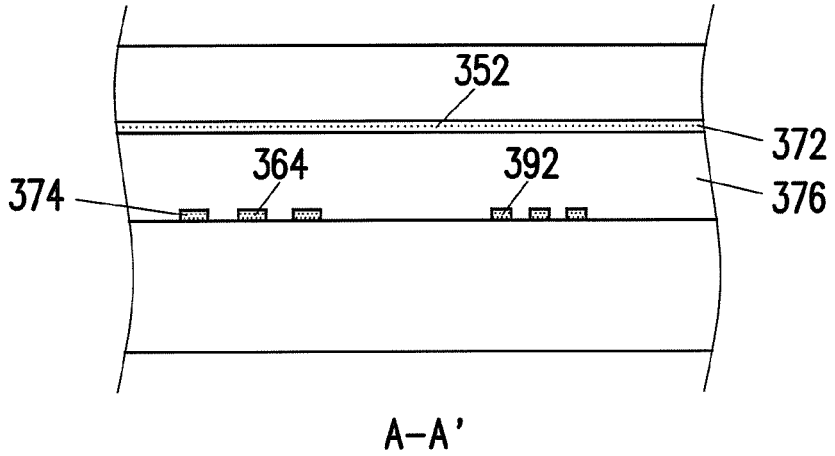
FIG. 5 is a cross-sectional view taken along line A-A' of FIG. 4.

FIG. 5 is a cross-sectional view taken along line A-A' of FIG. 4. Referring to FIGS. 4 and 5 together, the display panel 300 includes a first circuit layer 372, a second circuit layer 374, and an insulating layer 376, which may respectively be a metal stack layer of Ti/Al/Ti, etc., a $SiO_2$ layer, a metal stack layer of Mo, etc., for example. The first circuit layer 372 is located above the second circuit layer 374, and the insulating layer 376 is located between the first circuit layer 372 and the second circuit layer 374, such that the first circuit layer 372 is insulated from the second circuit layer 374. Here, the first circuit layer 372 includes the first data lines 352, the second data lines 354, the first scan lines 362, and the bus line segments 394. The second circuit layer 374 includes the second scan lines 364 and the connecting line segments 392. Of course, there may be a plurality of conductive vias in the insulating layer 376. The conductive vias are configured to bridge the bus line segments 394 and the connecting line segments 392 as well as other possible circuits. By disposing the circuit layers, intersecting lines in the layout region, such as the connecting line segments 392 and the first data lines 352 or the second scan lines 364 and the first data line 352, as shown in FIG. 4, may cross each other without interference. Of course, in other embodiments not shown herein, three or more circuit layers may be chosen to form the lines, so as to offer a greater tolerance to the circuit layout.

Based on the above, the embodiment uses the demultiplexer 340 to reduce the number of the first data lines 352, and the first data lines 352 and the second data lines 354 are divided into groups, such that the first and second data lines 352 and 354 are coupled to the demultiplexers 350 arranged along the edge of the display region 310, so as to effectively use a layout space in the layout region 320.

Figure 6:
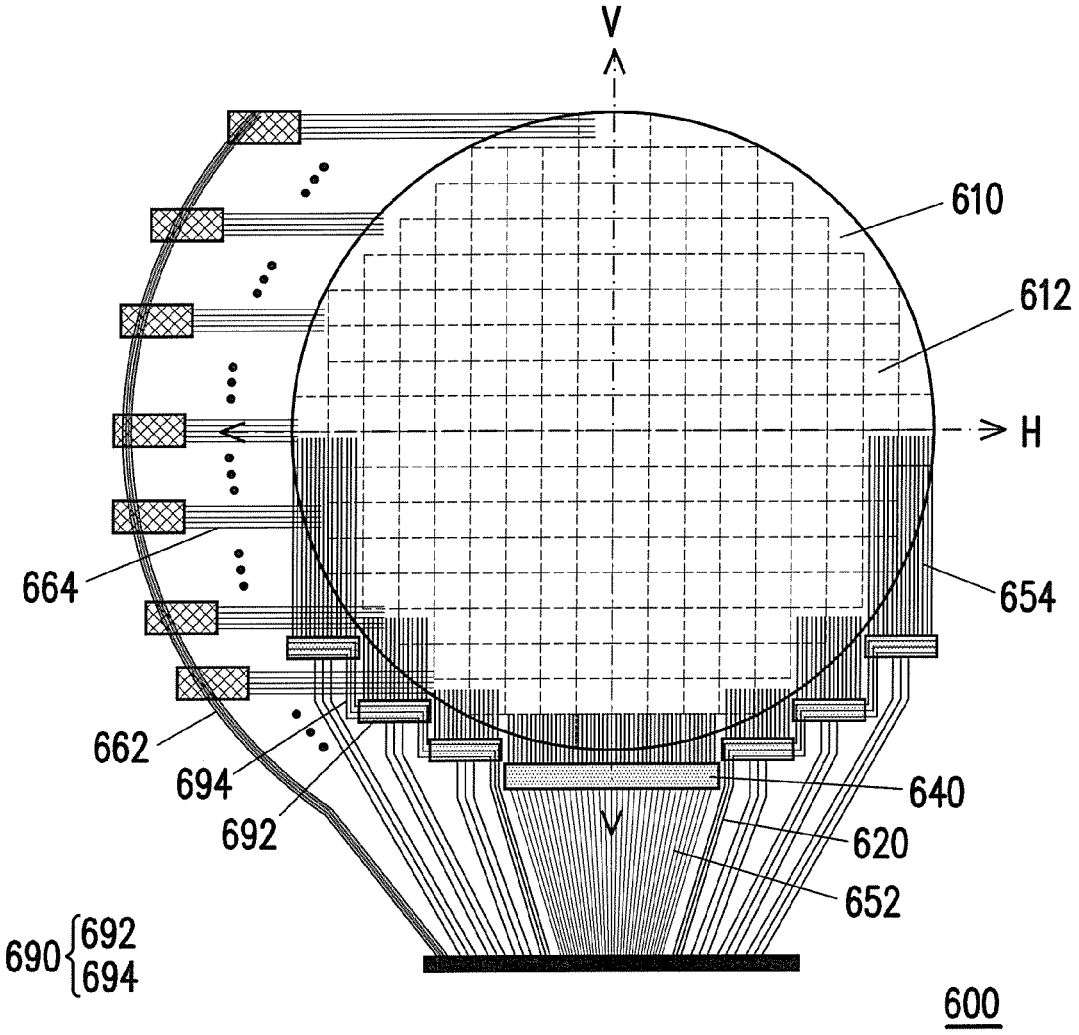
FIG. 6 is a view illustrating a display panel according to another embodiment of the invention.
Figure 7:
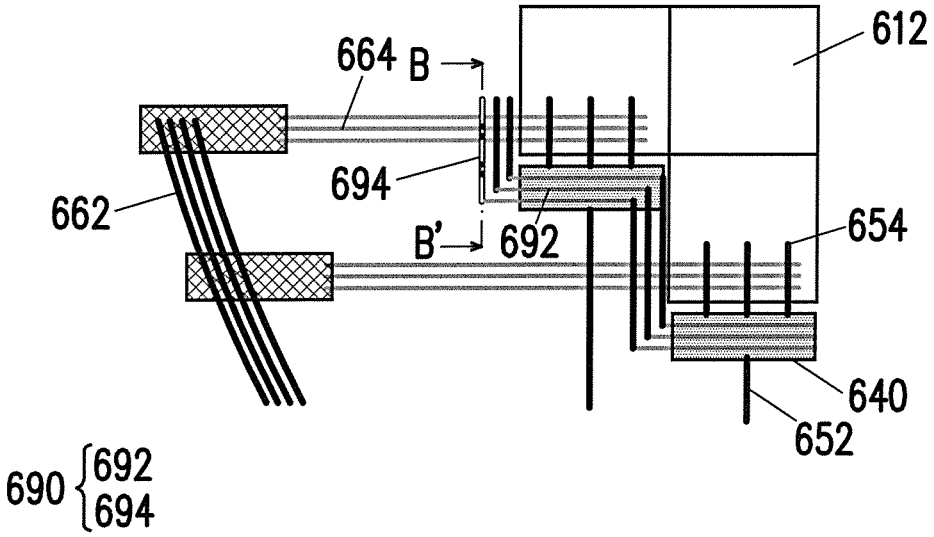
FIG. 7 is a partial schematic view of the display panel shown in FIG. 6.

FIG. 6 is a view illustrating a display panel 600 according to another embodiment of the invention. FIG. 7 is a partial schematic view of the display panel 600 shown in FIG. 6.

The display panel 600 in this embodiment is similar to the display panel 300 in the previous embodiment. A plurality of pixel structures 612 are disposed in a display region 610, and, similarly, demultiplexers 640 are used to reduce the number of first data lines 652. Also, the first data lines 652 and second data lines 654 are divided into groups, such that the first and second data lines 652 and 654 are coupled to the demultiplexers 640 arranged along an edge of the display region 610 to effectively use a layout space in a layout region 620. In addition, first scan lines 662 may be curved lines parallel to the edge of the display region 610. For example, the display region 610 of this embodiment is circular, so the first scan lines 662 may be arc lines parallel to the edge of the display region 610. Other description about the same or similar components may be referred to the previous embodiment, and is not repeated in the following.

A difference between this embodiment and the previous embodiment includes: a layout of control lines 690 in this embodiment is different from the layout of the control lines 390 in the previous embodiment. As shown in FIGS. 6 and 7, each of the control lines 690 in this embodiment includes a plurality of first line segments 692 and a plurality of second line segments 694. The first line segments 692 are located in the layout region 620, and are coupled to and cross the corresponding demultiplexer 640 respectively. The second line segments 694 are located in the layout region 620. The first and second line segments 692 and 694 are alternatively arranged, and the first and second line segments 692 and 694 are coupled to each other through their head and tail portions. In other words, each of the control lines 690 in this embodiment is closely adjacent to the edge of the display region 610 and formed by alternately connecting the first line segments 692 parallel to the horizontal axis H and the second line segments 694 parallel to the vertical axis V, so as to form a step-like circuit structure closely adjacent to the edge of the display region 610. In this way, the layout space in the layout region 620 may be saved.

Figure 8:
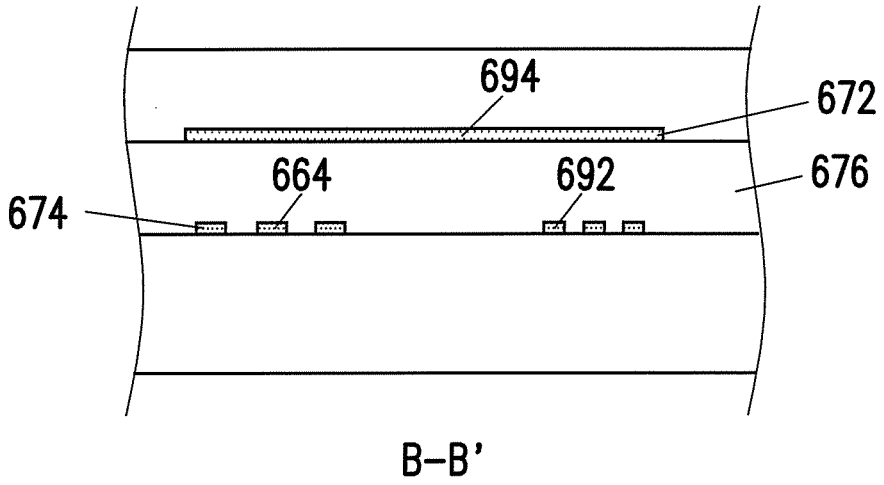
FIG. 8 is a cross-sectional view taken along line B-B' of FIG. 7.

In addition, similar to the previous embodiment, manufacture of the control lines 690 in this embodiment may be integrated into manufacture processes of the first scan lines 662, the second scan lines 664, the first data lines 652, and the second data lines 654. A circuit layout required by the first scan lines 662, the second scan lines 664, the first data lines 652, the second data lines 654, and the control lines 690 may be provided by using two or more circuit layers. FIG. 8 is a cross-sectional view taken along line B-B' of FIG. 7. A first circuit layer 672 is located above a second circuit layer 674, and an insulating layer 676 is located between the first circuit layer 672 and the second circuit layer 674, such that the first circuit layer 672 is insulated from the second circuit layer 674. In this embodiment, the first circuit layer 672 includes the first data lines 652, the second data lines 654, the first scan lines 662, and the second line segments 694. The second circuit layer 674 includes the second scan lines 664 and the first line segments 692.

Figure 9:
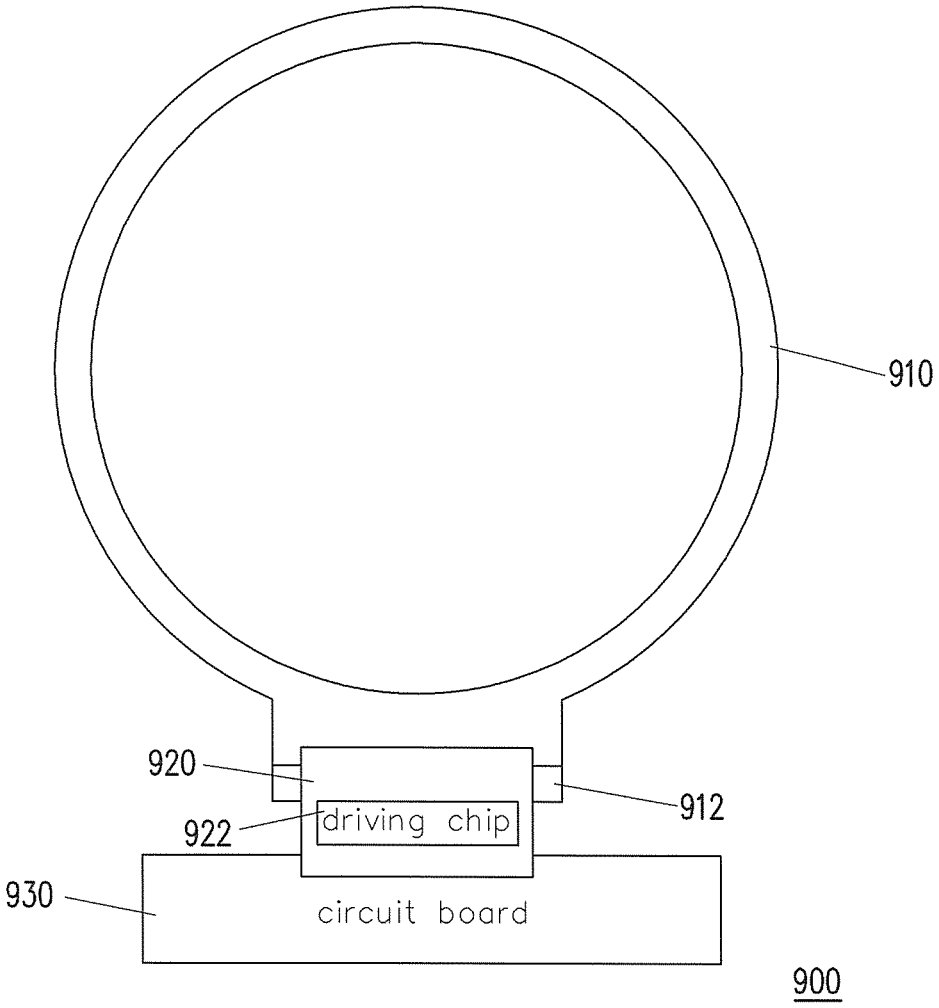
FIG. 9 is a schematic view illustrating a display apparatus according to an embodiment of the invention.

FIG. 9 is a schematic view illustrating a display apparatus 900 according to an embodiment of the invention. The display apparatus 900 includes a display panel 910 and at least one driving element 920. The display panel 910 is the display panel 300 or the display panel 600 shown in the previous embodiments, and the driving element 920 is disposed at an external circuit region 912 to electrically connect a leading portion of a corresponding conductive line (e.g., a leading portion of the first data line 352 shown in FIG. 3). The driving element 920 includes a driving chip 922, and is in a tape carrier package (TCP) package structure, for example, and is externally connected to a circuit board 930. In other embodiments of the invention not shown herein, the driving element 920 may also be a chip-on-film (COF) package structure or a driving chip directly disposed on a surface of the display panel 910 by adopting the surface mount technique (SMT). The invention does not intend to limit the way the driving chip is electrically connected to the display panel.

In view of the foregoing, the invention not only uses the demultiplexers to reduce the number of the data lines in the layout region, but further divides the data lines into groups, such that the data lines are coupled to different demultiplexers. The demultiplexers are arranged along the edge of the display region to comply with the outline of the display region, so as to save the layout space. In addition, the layout of the control lines of the demultiplexers is designed to more effectively use the layout space in the layout region. Thus, the invention not only helps development of a slim bezel design of the display apparatus or increases a visible region of the display panel, but also significantly simplifies the layout of conductive lines and reduces the length of the conductive lines, so as to ensure the accuracy of signal transmission between the conductive lines.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, having a display region, a layout region, and an external circuit region, wherein the external circuit region is located at an edge of the display panel, the layout region is located between the display region and the external circuit region, and the display panel comprises:

a plurality of pixel structures, disposed in the display region;

a plurality of demultiplexers, disposed in the layout region, wherein the demultiplexers are arranged along an edge of the display region, and at least two of the demultiplexers are not located on the same horizontal axis;

a plurality of first data lines, extending from the external circuit region to the layout region and respectively coupled to the demultiplexers;

a plurality of second data lines, vertical to the horizontal axis and divided into a plurality of groups, wherein at least two second data lines in each of the groups are coupled between the corresponding demultiplexer and the corresponding pixel structures, and each of the demultiplexers receives a first data signal from the corresponding first data line, multiplexes the first data signal into at least two second data signals, and respectively transmits the at least two data signals to the at least two second data lines;

a plurality of control lines, extending from the external circuit region to the layout region and respectively coupled to the demultiplexers, wherein the control lines comprise:

a plurality of connecting line segments, located in the layout region, wherein the connecting line segments are divided into a plurality of groups, and at least two connecting line segments in each of the groups are coupled to the corresponding demultiplexer; and a plurality of bus line segments, extending from the external circuit region to the layout region and coupled to the corresponding connecting line segments;

a plurality of gate drivers, disposed in the layout region;

a plurality of first scan lines, extending from the external circuit region to the layout region and respectively coupled to the gate drivers; and a plurality of second scan lines, divided into a plurality of groups, wherein at least two second scan lines in each of the groups are coupled between the corresponding gate driver and the corresponding pixel structures, and a portion of each of the plurality of bus line segments and a portion of each of the plurality of first scan lines conform to the edge of the display region.

2. The display panel as claimed in claim 1, comprising:

a first circuit layer, comprising the first data lines, the second data lines, the first scan lines, and the bus line segments;

a second circuit layer, alternately stacked with the first circuit layer, wherein the second circuit layer comprises the second scan lines and the connecting line segments; and an insulating layer, located between the first circuit layer and the second circuit layer, such that the first circuit layer is insulated from the second circuit layer.

3. The display panel as claimed in claim 1, wherein at least two of the bus line segments are arranged to be side by side and parallel to the first scan lines.

4. The display panel as claimed in claim 1, wherein the edge of the display region is curved and the portion of each of the plurality of bus line segments and the portion of each of the plurality of first scan lines are parallel to the edge of the display region.

5. The display panel as claimed in claim 1, wherein the display region is circular, and each of the bus line segments is an arc line parallel to the edge of the display region.

6. The display panel as claimed in claim 1, wherein the edge of the display region is curved, and each of the first scan lines is a curved line parallel to the edge of the display region.

7. The display panel as claimed in claim 1, wherein the display region is circular, and each of the first scan lines is an arc line parallel to the edge of the display region.

8. The display panel as claimed in claim 1, wherein each of the control lines comprises:

a plurality of first line segments, located in the layout area, wherein the first line segments are coupled to and cross the corresponding demultiplexers respectively; and a plurality of second line segments, located in the layout region, wherein the first line segments and the second line segments are arranged alternately, and the first and second line segments are coupled to each other through their head or tail portions.

9. The display panel as claimed in claim 8, comprising:

a first circuit layer, comprising the first data lines, the second data lines, the first scan lines, and the second line segments;

a second circuit layer, alternately stacked with the first circuit layer, wherein the second circuit layer comprises the second scan lines and the first line segments; and an insulating layer, located between the first circuit layer and the second circuit layer, such that the first circuit layer is insulated from the second circuit layer.

* * * * *